United States Patent [19]
Teetz et al.
[11] 4,452,156
[45] Jun. 5, 1984

[54] VARIABLE THREAD TENSIONER FOR EMBROIDERY MACHINES

[75] Inventors: Wolfgang Teetz, Kerken; Heinz-Georg Slomma, Viersen; Hans-Gerd Ripkens, Goch, all of Fed. Rep. of Germany

[73] Assignee: Maschinenfabrik Carl Zangs Aktiengesellschaft, Krefeld, Fed. Rep. of Germany

[21] Appl. No.: 235,283

[22] Filed: Feb. 17, 1981

[30] Foreign Application Priority Data

Mar. 7, 1980 [DE] Fed. Rep. of Germany ..... 3008735

[51] Int. Cl.³ ..... D05C 11/08
[52] U.S. Cl. ..... 112/97; 112/255
[58] Field of Search ..... 112/254, 97, 98, 255; 66/213, 146; 242/150 R; 74/569; 28/194, 236

[56] References Cited

U.S. PATENT DOCUMENTS

| | | | |
|---|---|---|---|
| 2,158,197 | 5/1939 | Pikul | 112/255 X |
| 2,694,389 | 11/1954 | Turkish | 74/569 X |
| 4,254,723 | 3/1981 | Rothstein | 112/255 |
| 4,285,289 | 8/1981 | Bolldorf et al. | 112/98 |
| 4,300,465 | 11/1981 | Tsuboi | 112/255 |

FOREIGN PATENT DOCUMENTS

| | | | |
|---|---|---|---|
| 1685129 | 5/1971 | Fed. Rep. of Germany . | |
| 2362481 | 6/1975 | Fed. Rep. of Germany | 242/150 R |
| 2610229 | 9/1977 | Fed. Rep. of Germany . | |
| 2809848 | 9/1978 | Fed. Rep. of Germany . | |
| 292872 | 6/1928 | United Kingdom . | |
| 445020 | 4/1936 | United Kingdom | 112/254 |
| 839233 | 6/1960 | United Kingdom . | |

*Primary Examiner*—Werner H. Schroeder
*Assistant Examiner*—Andrew M. Falik
*Attorney, Agent, or Firm*—Martin A. Farber

[57] ABSTRACT

A device for adjusting the thread tension of multi-needle automatic embroidery machines in which each needle or thread lever has associated with it a thread brake having two brake disks between which there extends a thread which is guided over the thread lever to the needle. One of the brake disks which are pressed against each other by a spring is displaceable relative to the other brake disk in order to change the thread tension. To set the thread tension for all the needles embroidering and at the same time for those needles which are disconnected to zero or a maximum value, the displaceable brake disk (11) of each thread brake is mounted on a bolt (13) which is displaceable relative to both brake disks (10, 11). The bolt is provided with an abutment (13c) for carrying along the displaceable brake disk (11). Each bolt (13) of each of the thread brakes is displaceable by one of several cams (15) which are arranged jointly on a camshaft (16). The camshaft (16) can be driven by a servomotor which can be controlled by information from a data storage device which controls the automatic embroidery machine.

16 Claims, 7 Drawing Figures

VARIABLE THREAD TENSIONER FOR EMBROIDERY MACHINES

BACKGROUND OF THE INVENTION

1. Field of the Invention

The present invention relates to a device for adjusting the thread tension on multi-needle automatic embroidery machines.

2. Description of Prior Art

In some known automatic embroidery machines with a plurality of needles which are available on the market an adjustment of the thread tension is possible only by manual adjustment of an individual thread brake associated with each needle. This requires extensive adjustment work and frequently results in different thread tensions on those needles which are embroidering at the same time. It is thus desirable to provide means whereby the thread tension for the needles which are embroidering at the time can be set separately to any desired value between zero and a maximum and the thread tension for the needles which are disconnected at the time is set automatically to zero or the maximum value.

SUMMARY OF THE INVENTION

An object of the present invention is to create a novel device for adjusting the thread tension on multi-needle automatic embroidery machines.

In a preferred embodiment of the invention each needle or thread lever has associated with it a thread brake which comprises two brake discs between which there extends a thread guided via the thread lever to the needle and of which one of the brake discs, which are pressed against each other by a spring, is displaceable relative to the other brake disc in order to change the thread tension. The displaceable brake disk of each thread brake is mounted on a bolt which is displaceable relative to both brake disks and is provided with an abutment for carrying along the displaceable brake disk. The bolts of all thread brakes can be displaced in each case by one of several cams which are arranged jointly on a cam shaft. Further in order to bring the thread tension of the disconnected needles either to zero or to the maximum value in such automatic embroidery machines, the thread brakes together with the bolts, and respectively, the camshaft together with the cams are mounted on separate structural parts of the automatic embroidery machine, which parts are displaceable relative to each other in the longitudinal direction of the camshaft. In this way either different or differently directed cams can cooperate with the different bolts, or the bolts of the thread brakes disconnected at the time can be brought out of engagement with the cams so that these thread brakes of the needles which are not participating in the embroidery process which is being carried out are automatically set either to zero or to the maximum value of the thread tension.

By this development there is not only made possible joint simultaneous adjustment of the thread tension of all thread brakes by the cams arranged on a common cam shaft, but also an automatic setting of the thread tension either to zero or to the maximum value on those needles which are not participating in the embroidering process at the time.

Whether a thread tension of zero or a maximum thread tension is set for the thread brakes of the needles disconnected at the time depends not only on the nature of the automatic embroidering machine, but also on the embroidering job which is to be carried out at the time as well as on the materials used.

In one preferred embodiment of the invention, the spring which produces the thread tension is arranged between the displaceable brake disk and a spring plate on the free end of the bolt. This part of the bolt which carries the spring plate can, in a further development of the invention, be formed as a threaded pin and the spring plate can be formed as an adjustment nut. In this way it is possible to adjust the thread tensions of the individual thread brakes manually, independently of each other.

In accordance with another feature of the invention—the abutment of the bolt is formed by an annular end surface between the threaded pin and a section of the bolt of enlarged diameter. The bolt is mounted for axial displacement within a sleeve formed on the stationary brake disk which is mounted on a bracket or support plate of the automatic embroidery machine.

The bolt of each thread brake can be provided with a pressure plate for the corresponding cam. In order to assure the engagement of the pressure plate against the corresponding cam, the bolt can be biased in the direction towards the cam by means of a compression spring. This compression spring is suitably arranged between the bracket and the pressure plate.

In another embodiment of the invention, each bolt is provided with a yoke against which there acts an arm of a lever which can be actuated by a cam. This lever is developed as a bell-crank lever, the other arm of which can be swung by the cam. For this embodiment it is not necessary to provide an additional compression spring in addition to the spring which produces the thread tension.

In accordance with the invention, particularly for automatic embroidery machines having at least one multi-needle embroidery head, the bracket is displaceable with the thread brakes parallel to the longitudinal direction of the cam shaft, which is fixed in position, so that one bolt of a thread brake cooperates with the cam associated with each embroidery head. In this way the thread tension for the needle embroidering at the time can be adjusted while the thread brakes of the needles of the multi-needle embroidery head which are not embroidering are out of engagement with the cam. Depending on the development of the device of the invention, the thread brakes of these disconnected needles are either set to maximum thread tension in order to hold the thread fast or to a thread tension of zero for the release of the thread, this taking place automatically as soon as the cam releases the bolt of the thread brake.

In order to assure proper cooperation in case of a relative movement between the bolts of the thread brakes and the control cams, the pressure plates of the bolts are provided with run-on bevels for the cams or the yokes of the bolts are provided with guide pieces of inclined shape.

BRIEF DESCRIPTION OF THE DRAWINGS

Three illustrative preferred embodiments of the device of the invention are shown in the drawing, in which.

DESCRIPTION OF THE PREFERRED EMBODIMENTS

Figure 1:
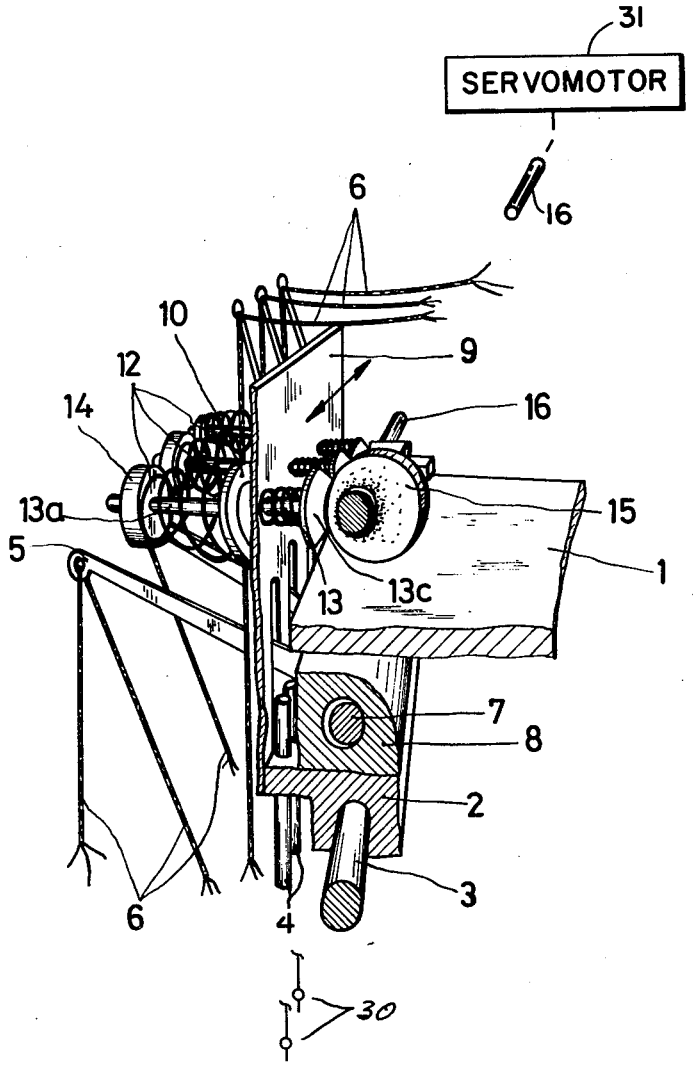
FIG. 1 is a perspective view of a part of an embroidery machine comprising the device of the invention, shown in a first embodiment.

In the case of the first embodiment, shown in FIGS. 1 to 3, there can be noted in FIG. 1 a part of a support 1 of an automatic embroidery machine below which a needle-bar block 2 is displaceably arranged relative to the support 1 on a guide bar 3. The needle-bar block 2 contains several needle bars 4, only one of which is in each case driven while the others do not participate in the embroidering. The selection of the needle bar 4 for embroidering is effected by the relative movement of the needle-bar block 2 with respect to the support 1.

Each needle bar 4 has associated with it a thread lever 5 via which a thread 6 is guided from a thread brake to the needle 30. The thread levers 5 are mounted on a drive shaft 7 which is mounted for rotation in a bearing block 8 connected to the needle bar block 2 and carries out, for the driving of the thread levers 5, an oscillating drive movement, i.e. a movement which moves back and forth through a given angle of rotation.

A plurality of thread brakes, which correspond to the number of needle bars 4 is also displaceable with the needle bar block 2, namely by the arrangement thereof on a bracket or support plate 9 which is fastened to the front side of the needle bar block 2. A displacement of the needle bar block 2 on the guide bar 3 thus results in a relative movement between the fixed support 1 and the needle bars 4, thread levers 5 and thread brakes.

Figure 2:
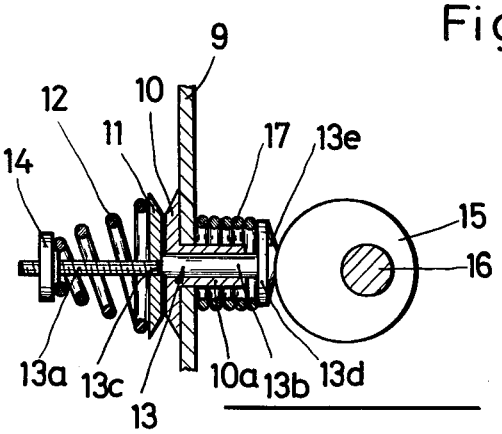
FIG. 2 is a longitudinal section through a thread brake in accordance with FIG. 1, with a thread tension of zero.
Figure 3:
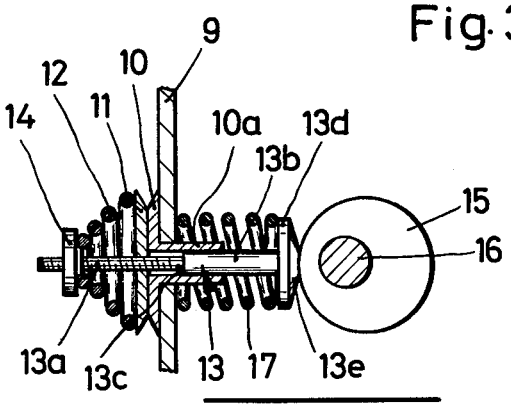
FIG. 3 is a longitudinal section corresponding to FIG. 2, with maximum thread tension.

As can best be noted from FIGS. 2 and 3, each thread brake comprises a stationary brake disk 10 and a displaceable brake disk 11 which is pressed against the brake disk 10 by a spring 12. Since the thread 6 extends between the two brake disks 10 and 11, the force of the spring 12 exerted on the displaceable brake disk 11 determines the instantaneous thread tension.

On the stationary brake disk 10 there is formed a sleeve 10*a*, by means of which the brake disk 10 is mounted on the bracket 9. The sleeve 10*a* serves at the same time to support a bolt 13 which is displaceable relative to the two brake disks 10 and 11. This bolt 13 is developed at its front end as a threaded pin 13*a* on which the displaceable brake disk 11 is mounted. This threaded pin 13*a* furthermore bears an adjustment nut 14 which serves as spring plate for the spring 12. In the embodiment shown, this spring 12 is developed as a conical spring, the larger diameter of which rests directly against the displaceable brake disk 11.

The rear portion of the bolt 13, located to the right in FIGS. 2 and 3, is developed as a smooth-walled bolt section 13*b* of enlarged diameter. Between the threaded pin 13*a* and the bolt section 13*b* of enlarged diameter there is an abutment 13*c* formed as an annular end surface. By means of this annular end surface 13*c* the displaceable brake disk 11 can be pushed away from the stationary brake disk 10 when the bolt 13 is moved to the left in FIGS. 2 and 3. In this way it is possible to change the tension of the thread 6 by a relative displacement of the brake disk 11 with respect to the brake disk 10.

In the embodiment of FIGS. 1 to 3, the displacement of the bolt 13 is effected by a cam 15 which is keyed on a camshaft 16. This camshaft 16 is mounted, as shown in FIG. 1, for rotation on the support 1 of the automatic embroidery machine. For cooperation with the cam 15, the bolts 13 are provided with pressure plates 13*d*. In order to assure a strong application of these pressure plates 13*d* against the cam 15 and to produce a return movement of the displaceable brake disk 11, a compression spring 17 is provided between each pressure plate 13*d* and the support plate 9.

By turning the cam 15 by means of the camshaft 16 the spring tension of the thread brake whose construction has been described above can be continuously varied. In FIG. 2 the bolt 13 has been displaced to the left by its maximum displacement path. In this connection, by means of its annular end surface 13*c* it has carried along with it the displaceable brake disk 11 so that the distance between the facing surfaces of the brake disks 10 and 11 is so large that a thread 6 passing between the brake disks 10 and 11 is not braked. A thread tension of zero thus results.

Upon the turning of the cam 15 from the position shown in FIG. 2 into the position shown in FIG. 3, the thread tension increases continuously since the contour of the cam 15 permits displacement of the bolt 13 in the direction towards the camshaft 16. The displacement is effected by the compression spring 17 which sees to it that the pressure plate 13*d* rests continuously against the cam 15. Since upon such a movement of displacement of the bolt 13, the annular end surface 13*c* enters into the sleeve 10*a* of the brake disk 10 and thus becomes inactive, the spring 12 now determines the pressing force which is exerted by the brake disk 11 on the brake disk 10, which force in its turn is controlling for the tension produced in the thread 6. An adjustment of the thread tension produced in each case can be effected by hand by means of the spring plate which is developed as an adjustment nut 14 if said adjustment nut 14 is displaced in the axial direction on the threaded pin 13*a* of the bolt 13.

While a continuous adjustment of the thread tension by means of the camshaft 16 can be obtained in the above-described manner for that thread brake whose needle is participating at the time in the embroidery process, in the case of the other thread brakes, the displaceable brake disk 11 is pressed with maximum spring force against the brake disk 10. This is obtained in the manner that the bolts 13 which do not cooperate with the cam 15 are displaced into their extreme end position, towards the right in FIGS. 2 and 3, by the force of the corresponding spring 17. Since the force of the compression spring 17 is greater than that of the spring 12, the spring 12 is completely compressed in this end position. The displaceable brake disk 11 rests accordingly against the brake disk 10 with maximum spring force. The thread tension of the thread brakes corresponding to the needles disconnected at the time thus reaches the maximum value.

Upon relative movement of the needle-bar block 2 with respect to the support 1 in order to change the needle bar 4 which is participating in the embroidering process, there simultaneously takes place a relative movement between the bolts 13 and the cam 15 which is associated with several bolts 13. In this connection the run-on bevels 13*e* of the pressure plates 13*d* run onto the cam 15 so that a sudden displacement of the bolts 13 is avoided.

Figure 4:
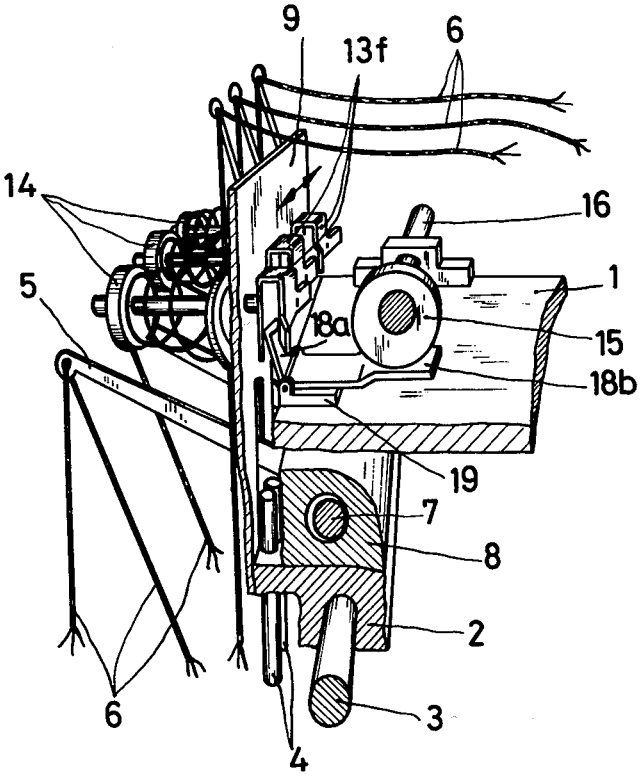
FIG. 4 is a perspective view corresponding to FIG. 1 of a second embodiment.
Figure 5:
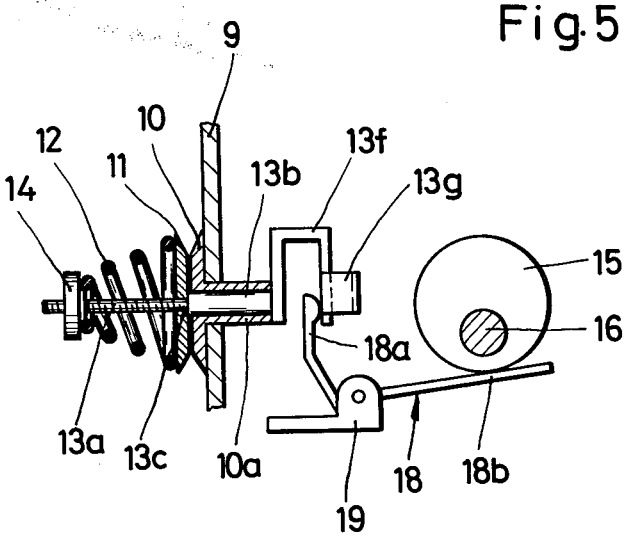
FIG. 5 is a longitudinal section through a thread brake of FIG. 4, with thread tension of zero.
Figure 6:
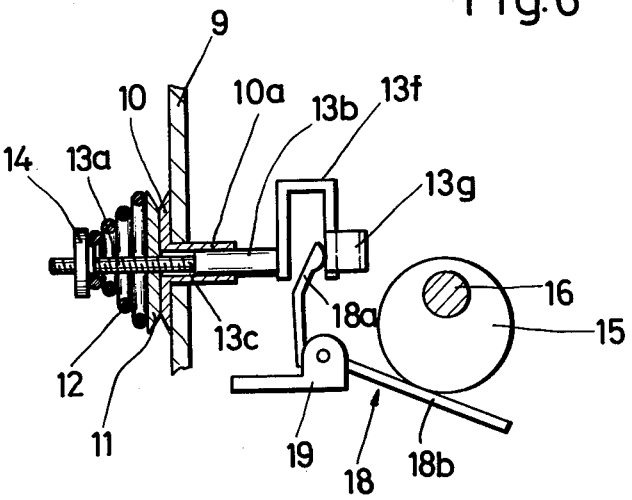
FIG. 6 is a longitudinal section corresponding to FIG. 5 with maximum thread tension.

The second embodiment of the displacement device, shown in FIGS. 4 to 6, has the same basic construction as already described with respect to FIGS. 1 to 3 so that corresponding parts of the two embodiments bear the same reference numbers.

The embodiment in accordance with FIGS. 4 to 6 differs from the one described above by the fact that the end of the bolts 13 which extends out of the sleeve 10*a* of the stationary brake disk 10 is provided with a yoke 13*f* into which an arm 18*a* of a bell crank lever 18 engages. The bell crank lever 18 which is mounted on a bearing pedestal 19 on the support 1 cooperates via its second arm 18*b* with the cam 15, which in this way cooperates not directly, but indirectly with in each case one bolt 13.

Since the spring 12 which is arranged between the adjustment nut 14 on the threaded pin 13*a* and the displaceable brake disk 11 pulls the bolt 13 back until its annular end surface 13*c* rests against the displaceable brake disk 11, the thread brakes associated with the disconnected needle bars 5 are in a position not acted on by the springs 12 when the arm 18*a* of the bell crank lever 18 is not in engagement with the yoke 13*f*. Only when the arm 18*a* displaces the yoke 13*f* against the force of the spring 12 as a result of a corresponding position of the cam 15 is thread tension produced.

In this case also, continuous adjustment of the thread tension via the cam shaft 16 is possible. In order, upon relative movement of the needle bar block 2 with respect to the support 1, to obtain a gradual cooperation of the arm 18*a* of the bell crank lever 18 with the yokes 13*f*, these yokes 13*f* are provided with guide pieces 13*g* of inclined shape.

Figure 7:
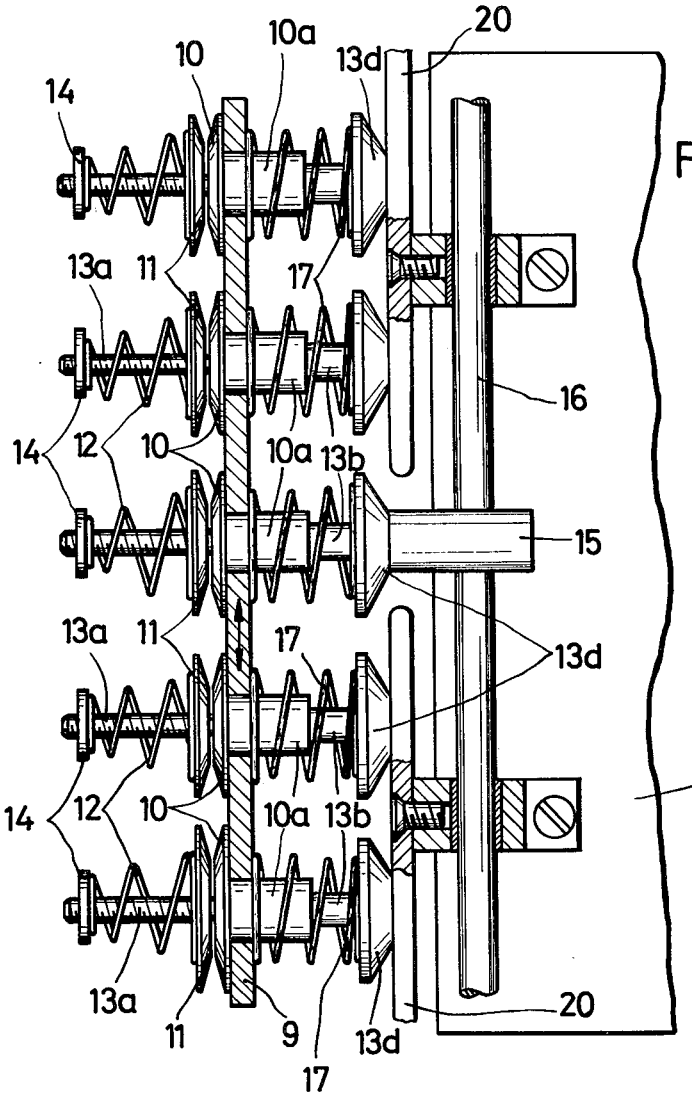
FIG. 7 is a top view of an embodiment which has been modified as compared with FIG. 1.

The third embodiment, indicated in FIG. 7, finally shows a further development of the embodiment of FIGS. 1 to 3. In this further development, push-off strips 20 are provided on the support 1 on both sides of the cam 15, said strips displacing the disconnected thread brakes via their pressure plate 13*d* against the force of the compression spring 17 in such a manner that the thread tension of zero is obtained at these thread brakes and only the thread brake which is associated with the embroidering needle, and whose pressure plate 13*d* lies between the push-off strips 20 which are spaced apart from each other, operates with the thread tension set at the time.

The above-described embodiment of a device for adjusting the thread tension on multi-needle automatic embroidery machines creates entirely new patterning possibilities, for instance shadings in the pattern, holes of different size and different shape and the use of threads of different smoothness since these patterning possibilities can be obtained by a change in the specific thread tension. Furthermore the thread tension can be changed upon transfer from embroidering to drilling and vice versa as well as in order to facilitate threading upon a break of the thread or upon the retooling of the machine. These changes can be effected at a central point for all needles participating in the embroidery process since the camshaft 16 extends behind all needles of the automatic embroidery machine, it being immaterial whether one uses embroidery machines with multiple embroidery heads each having one or more needles to embroidery machines having a single embroidery head with a plurality of needles. In both types of multi-needle automatic embroidery machines there is the possibility that only a portion of the needles is used for the specific embroidery process while the remaining needles are disconnected.

Since the camshaft 16 can be driven by a servomotor 31 which can be controlled by information from the data storage which controls the automatic embroidery machine, there is the possibility, with the above-described embodiments of also controlling the adjustment of the corresponding thread tension by the prearranged program.

We claim:

1. In a device for adjusting the thread tension on a multi-needle automatic embroidery machine having embroidery needles and a thread lever associated with each needle, a thread brake for each said thread lever, the thread brake having two brake discs between which there extends a thread which is guided over the associated thread lever to the associated needle, a spring for pressing the brake discs against each other, one of the brake discs being displaceable relative to the other brake disc in order to change the thread tension, a plurality of bolts, each of said bolts is displaceably mounted relative to both of said brake discs of each of said thread brakes respectively and is formed with an abutment means, the displaceable one of said brake discs of each said thread brake is mounted on one of said bolts, respectively, said abutment means is for carrying along said displaceable one of said brake discs, respectively, the improvement comprising cam means for displacing one of said bolts, respectively from time to time, a camshaft on which said cam means is arranged, a first and a second separate structural part are displaceable relative to each other in a longitudinal direction of said camshaft, and said thread brakes are mounted in said first structural part and said camshaft is mounted in said second structural part.

2. The device according to claim 1, further comprising servomotor means for driving said camshaft and for being controlled by information from a data storage which controls the automatic embroidery machine.

3. The device according to claim 1, further comprising spring plates, one of said spring plates respectively is mounted on a free end of each of said bolts, a spring is arranged between said displaceable brake disc and said spring plate.

4. The device according to claim 3, wherein said free end of said bolt is formed as a threaded pin, said spring plate constitutes an adjustment nut adjustably threaded on said threaded pin.

5. The device according to claim 1, further comprising a plurality of pressure plate means each for engaging said cam means is mounted on each of said bolts, respectively.

6. The device according to claim 5, wherein said pressure plate means of said bolts are formed with run-on bevels adapted to lead smoothly relative to said cam means.

7. The device according to claim 1, further comprising a compression spring means for biasing each of said bolts towards said cam means.

8. The device as set forth in claim 1, further comprising push-off strips are arranged in the longitudinal direction of the camshaft on both sides of the cam means on the said second structural part that mounts the camshaft, said bolts, other than said one bolt, which is displaced respectively from time to time by said cam means, engage said push-off strips.

9. In a device for adjusting the thread tension on a multi-needle automatic embroidery machine having embroidery needles and a thread lever associated with each needle, a thread brake for each said thread lever, the thread brake having two brake discs between which there extends a thread which is guided over the associated thread lever to the needle, a spring presses the brake discs against each other, one of the brake discs being displaceable relative to the other brake disc in order to change the thread tension, the improvement comprising a plurality of bolts, each of said bolts is displaceably mounted relative to both of said brake discs of each of said thread brakes respectively and is formed with an abutment means, the displaceable one of said brake discs of each thread brake is mounted on one of said bolts, respectively, said abutment means for carrying along said displaceable one of said brake discs, respectively, a plurality of cam means, each of said plurality of cam means respectively for displacing one of said bolts, respectively from time to time, of all of a respective group of the thread brakes, one camshaft on which said plurality of cam means is jointly arranged, spring plates, one of said spring plates respectively is mounted on a free end of each of said bolts, a spring is arranged between said displaceable brake disc and said spring plate, said free end of said bolt is formed as a threaded pin, said spring plate constitutes an adjustment nut adjustably threaded on said threaded pin, said bolt has a section adjoining said threaded pin having a diameter larger than said threaded pin forming an annular end surface of said section between the threaded pin and said section, said annular end surface constitutes said abutment means.

10. The device according to claim 9, further comprising a sleeve, said section of said bolt is axially displacably mounted in said sleeve.

11. The device according to claim 10, further comprising a support plate of said automatic embroidery machine, said sleeve is formed on the other of said two brake discs, said other disc constitutes a fixed one of said two brake discs and is mounted on said support plate.

12. The device according to claim 11, further comprising a plurality of pressure plate means each for engaging said cam means is mounted on each of said bolts, respectively, a compression spring means for biasing each of said bolts towards said cam means, said compression spring means is arranged between said support plate and said pressure plate means, respectively.

13. In a device for adjusting the thread tension on a multi-needle automatic embroidery machine having embroidery needles and a thread lever associated with each needle, a thread brake for each said thread lever, the thread brake having two brake discs between which there extends a thread which is guided over the associated thread lever to the needle, a spring for pressing one of the brake discs against the other brake disc, the one brake disc being displaceable relative to the other brake disc in order to change the thread tension, the improvement comprising a plurality of bolts, each of said bolts is displaceably mounted relative to both of said brake discs of each of said thread brakes respectively and is formed with an abutment means, the displaceable one of said brake discs of each thread brake is mounted on one of said bolts, respectively, said abutment means for carrying along said displaceable one of said brake discs, respectively, a plurality of cam means, each of said plurality of cam means respectively for displacing one of said bolts, respectively from time to time, of all of a respective group of the thread brakes, one camshaft on which said plurality of cam means is jointly arranged, each of said bolts has a yoke, a lever means for being actuated by said cam means has one arm acting against said yoke.

14. The device according to claim 13, wherein said lever means is formed as a bell crank lever, said lever means is mounted such that another arm of said lever means is swingable by said cam means.

15. The device according to claim 13, wherein said yokes of the bolts have guide pieces of a funnel shape.

16. In a device for adjusting the thread tension on a multi-needle automatic embroidery machine having embroidery needles and a thread lever associated with each needle, a thread brake for each said thread lever, the thread brake having two brake discs between which there extends a thread which is guided over the associated thread lever to the needle, a spring presses the brake discs against each other, one of the brake discs being displaceable relative to the other brake disc in order to change the thread tension, the improvement comprising a plurality of bolts, each of said bolts is displaceably mounted relative to both of said brake discs of each of said thread brakes respectively and is formed with an abutment means, the displaceable one of said brake discs of each thread brake is mounted on one of said bolts, respectively, said abutment means for carrying along said displaceable one of said brake discs, respectively, a plurality of cam means, each of said plurality of cam means respectively for displacing one of said bolts, respectively from time to time, of all of a respective group of the thread brakes, one camshaft on which said plurality of cam means is jointly arranged, a support plate is displaceable together with said thread brakes parallel to the longitudinal direction of said camshaft, said camshaft is mounted fixed in position.

* * * * *